United States Patent [19]

Batky et al.

[11] 4,300,299

[45] Nov. 17, 1981

[54] DISPLAY UNIT

[75] Inventors: Lester Batky; Michael P. Batky, both of Brooklyn; Jack Manne, New York, all of N.Y.

[73] Assignee: Almac Plastics, Ridgewood, N.Y.

[21] Appl. No.: 145,862

[22] Filed: May 1, 1980

[51] Int. Cl.[3] ..... G09F 15/00

[52] U.S. Cl. ..... 40/607; 40/10 R

[58] Field of Search ..... 40/607, 606, 608, 575, 40/572, 573, 489, 10 R, 16.2; 248/125

[56] References Cited

U.S. PATENT DOCUMENTS

| | | | |
|---|---|---|---|
| 77,545 | 5/1868 | Sonnedecker | 40/607 |
| 477,873 | 6/1892 | Shaw | 40/607 |
| 2,625,762 | 1/1953 | McColl | 40/607 |
| 3,015,899 | 1/1962 | Ensign et al. | 40/607 X |
| 3,241,257 | 3/1966 | Lapham | 40/607 X |

FOREIGN PATENT DOCUMENTS

| | | | |
|---|---|---|---|
| 3030 | 7/1932 | Australia | 40/607 |
| 121230 | 3/1948 | Sweden | 40/607 |

*Primary Examiner*—Gene Mancene
*Assistant Examiner*—Wenceslao J. Contreras
*Attorney, Agent, or Firm*—Eyre, Mann, Lucas & Just

[57] ABSTRACT

A display assembly comprising a substantially vandal-proof enclosure for sheets of advertising, bus schedules, and the like is adapted for assembly at the site and mounting on different types of poles so that removal of previously mounted fixtures is not required.

11 Claims, 7 Drawing Figures

DISPLAY UNIT

BACKGROUND OF THE INVENTION

The invention relates to displays and especially to displays for installation on street furniture.

SUMMARY OF THE INVENTION

A display assembly comprising an enclosure for displays of advertising, bus schedules, etc. is adapted for quick mounting to any number of different types of street furniture and completely surrounds a typical sign post, for instance, to provide four sides of display material at eye level.

The novel construction of the assembly provides a structure which is substantially vandalism-proof, but which, at the same time is easily assembled at the site. In addition, this construction enables the installation of the enclosure at the site without removal of any other displays, street signs, etc. which might normally be affixed to the top of the existing street furniture.

Transparent sheets of polycarbonate covering the display material are held in place by tracks on side panels. Top and bottom caps prevent unwarranted access to the display material. The displays are substantially impervious to the elements and to fire or to defacement and other such acts of vandalism which are normally associated with eye level displays. The material to be displayed is easily changed by removing the top cap.

Other objects and features of the invention will be made clear by reference to the figures.

Figure 1:
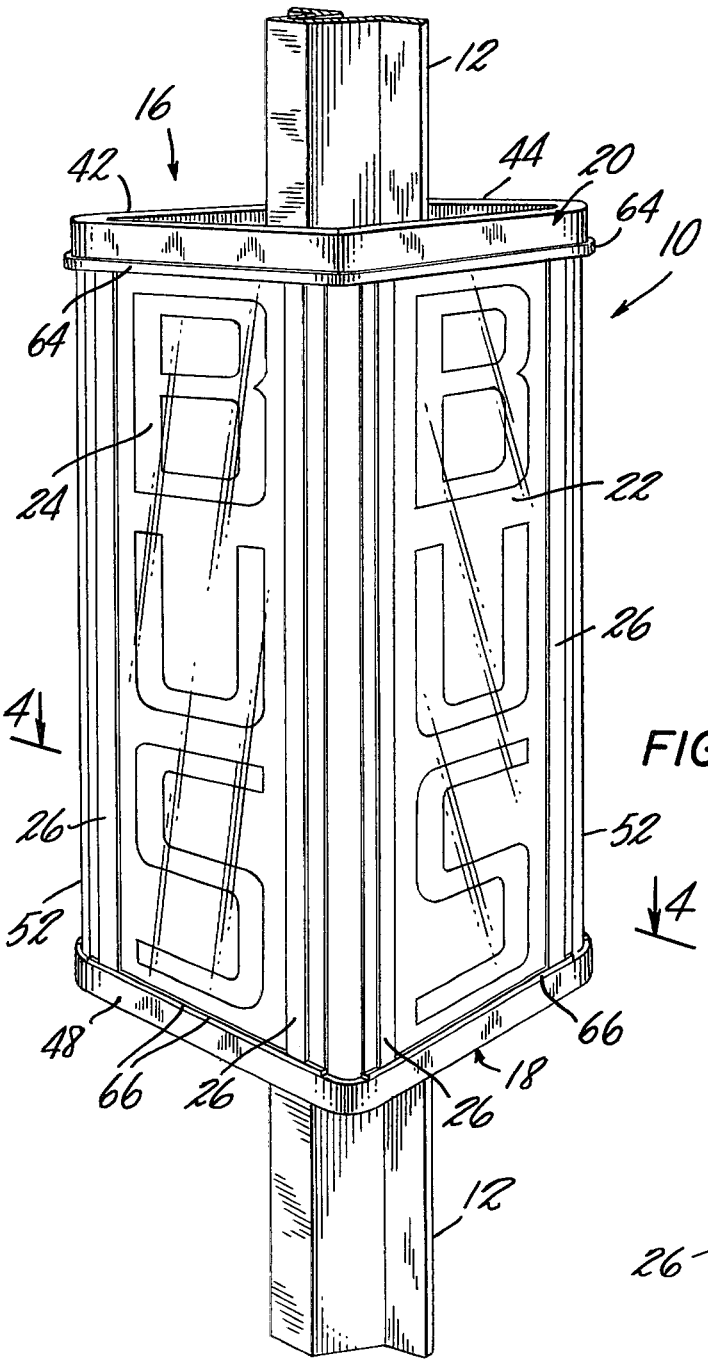
FIG. 1 shows a display according to the invention mounted on a typical bus stop pole.

In FIG. 1, the display enclosure according to the invention is shown generally at 10 mounted on a bus stop post 12 of generally U-shaped cross section. The display enclosure comprises separable display side panels 14 forming a tube 16 of rectangular cross section surrounding the post 12. A bottom cap 18 and a top cap 20 are secured to the panels. Display copy sheets 22 are inserted behind the transparent cover sheets 24 which are slidingly received in tracks 26. The top cap 20 prevents access to the display copy sheets 22. The transparent cover sheets 24 and the caps 18 and 20 protect the display copy sheets 22 from the elements and from vandalism.

Figure 2:
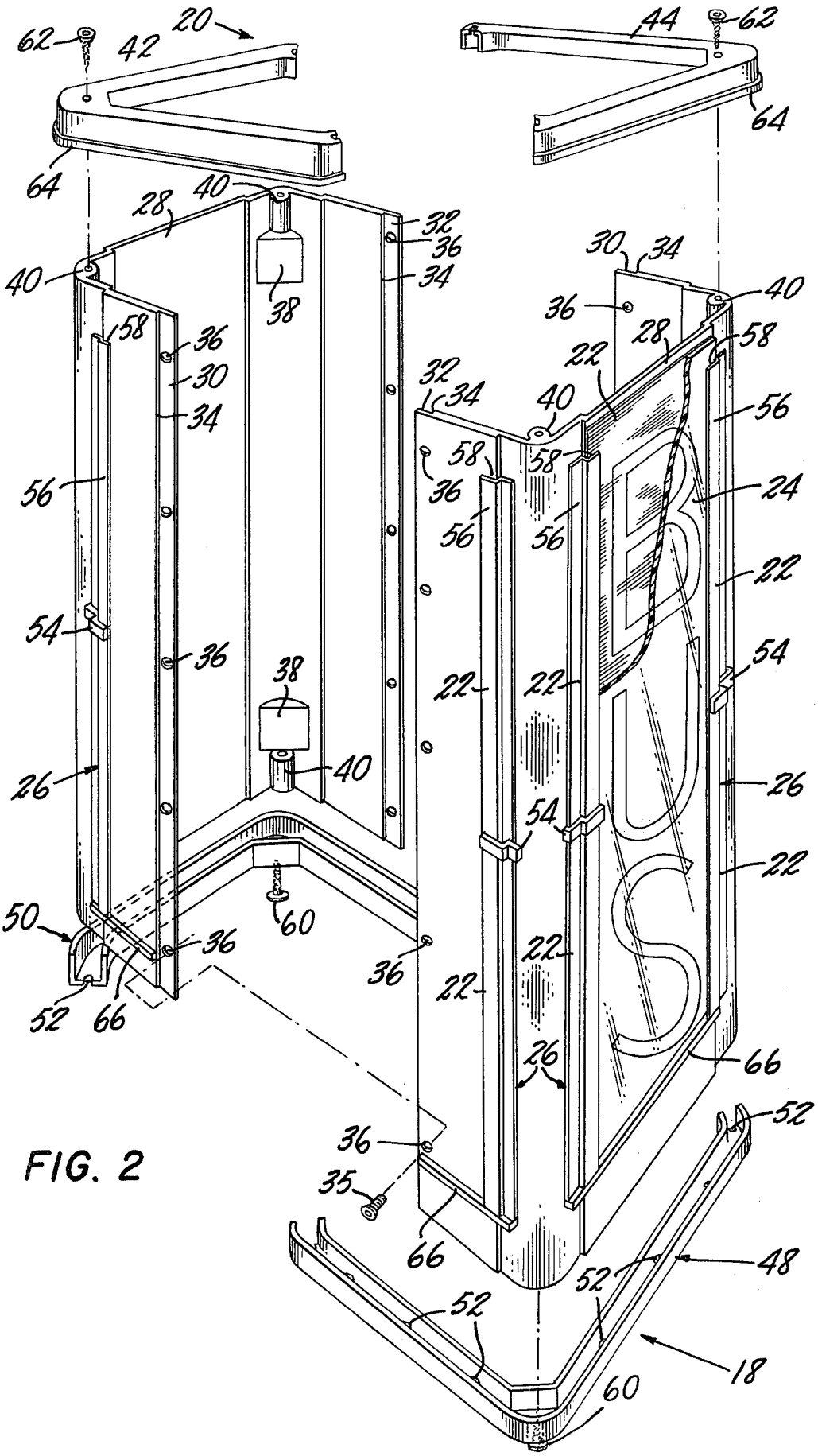
FIG. 2 is a partially-exploded perspective drawing of the assembly according to the invention.

FIG. 2 is a perspective drawing of the display enclosure of FIG. 1 partially exploded. Two identical generally U-shaped side panels 28, preferably made of molded polycarbonate material, have flanges 30 and 32 along the length of their side edges. The flanges, 30 and 32, are molded so that upon abutment, they overlap with shoulders 34 of panels 28, abutting against the end of flanges 30 and 32. The overlapping flanges 30 and 32 are fastened together by any well known conventional security means such as rivets 34 in a plurality of spaced, aligned holes 36 in the flanges 30 and 32. When fastened in this manner the panels 28 form a tube 16 of generally rectangular cross section.

Each corner of the U-shaped panels is reinforced by two molded projections 38 which also form a supporting attachment point for brackets (not shown). At the top and bottom of each corner bend of the U-shaped side panel 28 are molded cylindrical projections 40, for the purpose of providing fastening points for the top and bottom caps 18 and 20 respectively.

The top cap of the assembly is formed by two L-shaped members 42 and 44. A channel 46 in the L-shaped members receives a corresponding portion of the top end of the rectangular tube 16. The two L-shaped members 42 and 44 form a complete square fitting completely over the two abutting generally U-shaped side panels 28.

Figure 3:
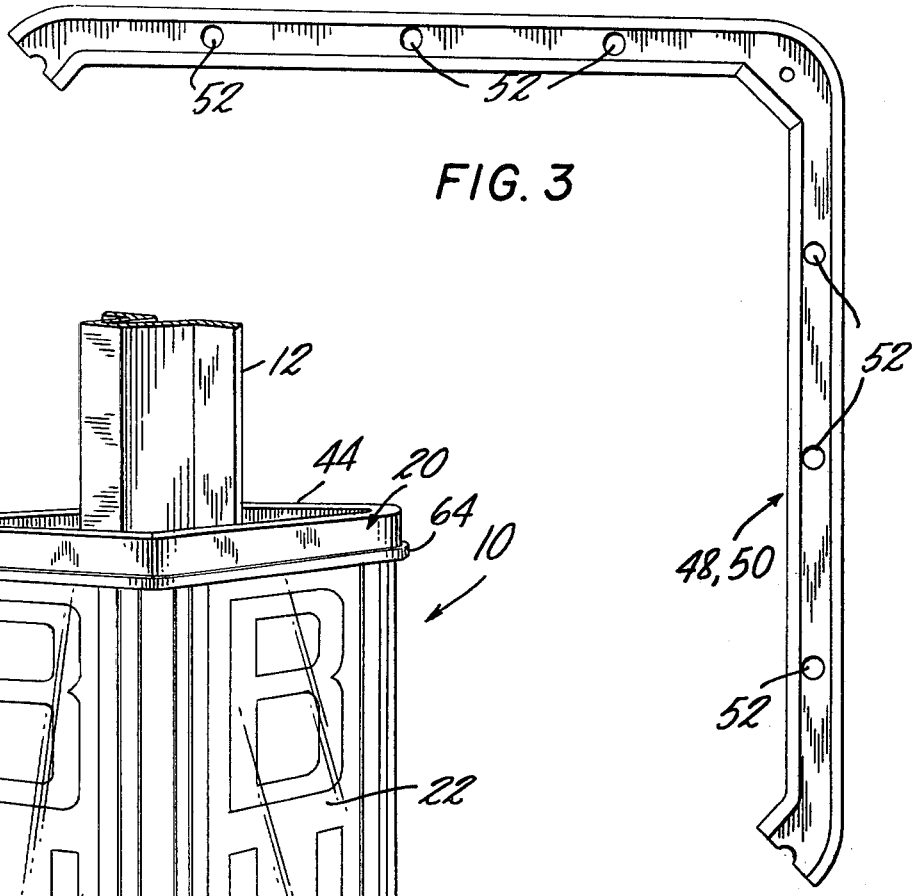
FIG. 3 is a top view of a bottom L-shaped cap showing weepholes.

A bottom cap 18 is formed by two L-shaped members 48 and 50 substantially similar to those of the top cap. The two L-shaped bottom members 48 and 50 when abutted also form a complete square which receives the corresponding bottom portion of the U-shaped side panels 28 in a channel 52. As is best shown in FIG. 3, the L-shaped bottom cap members 48 and 50 have weepholes 52 through which water will drain to the exterior.

Figure 7:
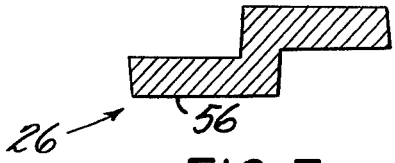
FIG. 7 illustrates the cross section of the tracks which hold the display material and cover.

Pairs of tracks 26 having offset cross section as shown in FIG. 7, are attached by conventional means (not shown) to the sides of the U-shaped panels 28. The tracks may be of unitary construction, however, for convenience and as shown in FIG. 2 the length of the tracks is extended as required by inserting the ends of smaller sections of track into a connecting fitting 54. With the track attached to the panel, the offset shoulder 56 of the track forms a slot 58 between itself and the side panel 28. The slot 58 thus formed slidingly receives a selected display copy sheet 22 and a covering transparent polycarbonate sheet 24.

The two L-shaped members 48 and 59 comprising bottom cap 18 are secured to the side panels 28 by security screws, such as, for example, self-tapping screws 60. The L-shaped members 42 and 44 of top cap 20 are secured to the top of the side panels 28 by screws 62 or other conventional means for providing secure fastening having quick removal capability.

A projecting lip 64 on the upper L-shaped members 42 and 44 overhangs the transparent cover sheets 24 to provide a run-off channel for rain or melted snow, etc. A set of lips 66 molded into the side panels provide a corresponding means of diverting rain and melted snow from the bottom cap 18.

The U-shaped side panels and L-shaped members are preferably molded from polycarbonate material, however, it would be obvious to anyone skilled in the art that the enclosure could be fashioned as well from any metal typically used for similar assemblies such as aluminum or steel.

Figure 4:
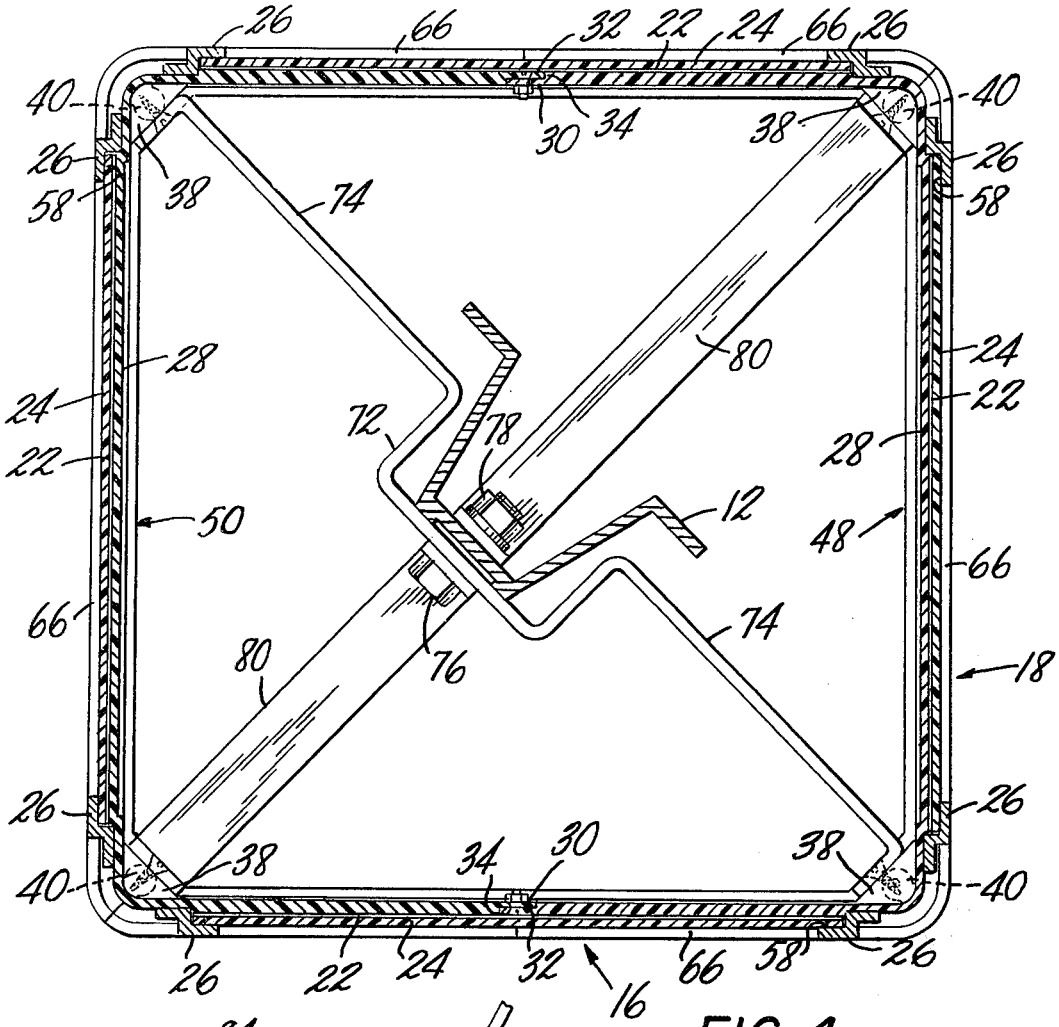
FIG. 4 is a top view of the assembly showing brackets for installing the enclosure on a U-shaped pole.

In FIG. 4, a top view of the mounting for the enclosure is illustrated with mounting brackets for attaching the display enclosure to a typical bus-stop post 12 of U-shaped cross-section. As shown in FIG. 4 a generally U-shaped bracket 72 having L-shaped wings 74 for attachment to the molded support blocks 38 at the top of the display enclosure tube is attached to the post 12 at the desired height by a conventional threaded bolt 76 and nut 78. The bracket 72 is attached to the support blocks 38 by self-tapping screws (not shown). The bracket 72 supports two opposite corners at the top of the display enclosure. A similar bracket (not shown) mounts to the bottom of the display enclosure tube. Two C-shaped angle brackets 80 attached perpendicularly to the U-shaped bracket by the same threaded bolt 76 and nut 78 are secured to the remaining opposite corner support projections at the top of the display enclosure tube. Similar brackets (not shown) are used to attach the bottom of the enclosure tube 16 to the post 12.

Figure 5:
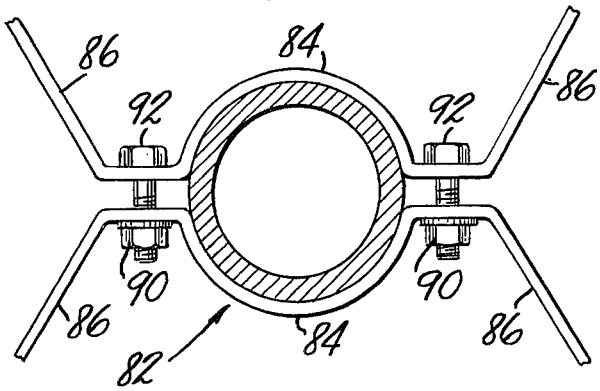
FIG. 5 is a top view of the brackets for a round pole.
Figure 6:
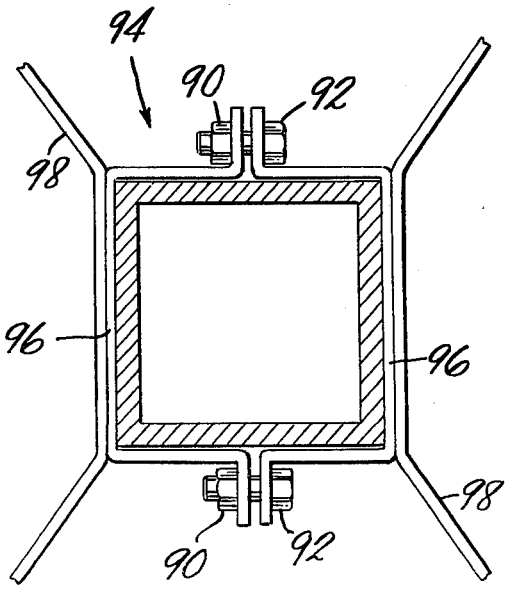
FIG. 6 is a top view illustrating the brackets for a square pole.

Other brackets for attaching the display enclosure to posts of different cross section from the typical U-shaped post are shown in FIGS. 5 and 6. FIG. 5 is a top view of the mounting showing a pair of brackets 82 which have generally semi-circular shape in a mid-portion 84 and projecting arms 86. The brackets 82 are clamped to a pole of circular cross section in a conventional manner such as by use of a pair of nuts 90 and bolts 92. The projecting arms 86 of the brackets are secured to the display enclosure 16 by self-tapping screws (not shown) or other security fasteners and in FIG. 6 in a similar manner to that shown in FIG. 5, brackets 94 comprising C-shaped clamp members 96 welded to arms 98 may be used to clamp the display enclosure to a pole of square cross section.

The assembly of the display enclosure is carried out at the site where the display is to be located. As best seen from FIG. 2, the two generally U-shaped side panels 28 are brought into abutment with flanges 30 and 32 over-lapping and with the post 12 enclosed between. The flanges 30 and 32 are then secured by rivets or other secure fastening means. The joined panels 28 forming display enclosure tube 16 are then inserted into channel 52 of the L-shaped bottom cap members 48 and 50 and secured by use of self-tapping screws 60. The display material 22 and transparent polycarbonate cover sheets 24 are inserted by sliding between the tracks 26 in the slots provided. The L-shaped top cap members 42 and 44 are fitted on the top of the panels 28 and secured by conventional screws 62.

For mounting, the bottom brackets 72 and 80 corresponding to those in FIG. 4 are loosely attached to the post 12 by use of bolts and nuts and are then secured to the mounting support projections 38 in each corner of the side panels 28 by use of security fasteners such as self-tapping screws. In a similar manner the top brackets 72 and 80 are loosely attached to the past 12 and secured to the support blocks 38 at the top of the side panels. Finally the nuts on the post-bolts are tightened to firmly secure the display enclosure 16 to the sign post 12. It is to be noted that by assembling the enclosure in this manner, there has been no necessity for removing any projecting material from the top of the post. Since the post has been erected typically for other used and the top normally has street signs, traffic signals, etc, there is a significant benefit derived from the assembly of the display enclosure at the site as it does not require removal of these signs or other such projecting items.

It is to be understood that the invention is not to be limited by the preferred embodiments chosen herein to represent it and the claims are intended to cover all changes and modifications of the preferred embodiments which do not constitute departures from the spirit and the scope of the invention.

What is claimed is:

1. A display assembly comprising:

(a) a pair of separable panels, each panel having sides thereon wherein each panel has a substantially U-shaped cross section;

(b) means for holding said separable panels in engaging abutment, the abutment being along the end portions of the sides of said separable panels, said engaging abutment forming thereby a tube of substantially rectangular cross-section adapted for encompassing an interior pole;

(c) means for mounting a transparent cover sheet on at least one exterior side of said tube, said transparent cover sheet being held spaced from said tube, the space allowing a display sheet to be received therebetween;

(d) a bottom cap for mounting at the bottom of said tube, said bottom cap comprising two L-shaped bottom members adapted for abutment at each end thereof for forming a substantially continuous bottom cap on the bottom periphery of said tube;

(e) a top cap for mounting on the top of said tube, said top cap comprising two L-shaped top members adapted for abutment at each end thereof to form a substantially continuous top cap on the top periphery of said tube; and (f) said top cap and said bottom cap preventing access to the space between said transparent cover and said tube.

2. The display assembly of claim 1 further comprising means for mounting said separable panels on a mounting pole.

3. The display assembly of claim 1 wherein said separable panels are polycarbonate material.

4. The display assembly of claim 1 wherein said separable panels are metal.

5. The display assembly of claim 1 wherein said top and bottom caps are removably affixed to said panels said bottom cap being fastened to said panels by use of security screws.

6. The display assembly of claim 5 wherein said bottom cap has weepholes.

7. The display assembly of claim 5 wherein said top and bottom caps are made of polycarbonate material.

8. The display assembly of claim 1 wherein said transparent cover is a transparent polycarbonate sheet.

9. The display assembly of claim 1 wherein said means for holding said transparent cover is a pair of tracks forming between themselves and said panels slots for slidably receiving said transparent cover.

10. A display assembly comprising:

(a) separable polycarbonate panels having U-shaped cross section;

(b) flanges on each of the sides of said separable panels, said flanges adapted to overlap whenever the sides of said panels are placed into abutment with one another;

(c) fastening means cooperating with said flanges to hold said panels in abutment;

(d) a plurality of tracks mounted on said panels;

(e) a plurality of transparent polycarbonate cover sheets;

(f) each pair of said plurality of tracks being adapted to slidingly receive one of said plurality of transparent polycarbonate cover sheets;

(g) each said transparent polycarbonate cover sheet being held spaced from said separable panels by said tracks, the space being adapted to receive a display sheet;

(h) a bottom cap comprising two L-shaped bottom members;

(i) security means for securing said L-shaped bottom members to the bottom of said separable panels;

(j) said bottom cap having a channel with walls extending beyond the ends of said separable panels when said bottom cap is secured to said separable panels;

(k) said bottom cap having a plurality of weepholes spaced along said channel;

(l) a top cap comprising two L-shaped top members;

(m) means for removably fastening said L-shaped top members to the top of said separable panels;

(n) said L-shaped top members having a channel with walls extending beyond the top ends of said separable panels when fastened to said separable panels;

(o) said top cap preventing access to the space between said transparent polycarbonate cover and said separable polycarbonate panels;

(p) said top cap having an overhanging lip;

(q) a plurality of mounting points on said separable polycarbonate panels; and (r) brackets for attaching said assembly to an interior pole.

11. A display assembly comprising:

(a) a pair of separable panels having U-shaped cross-section;

(b) each of said separable panels having flanges on sides thereof, said flanges being adapted to overlap whenever the sides of said panels are placed into abutment with one another;

(c) fastening means cooperating with said flanges for holding said panels in abutment;

(d) a plurality of tracks mounted on said panels;

(e) a plurality of transparent cover sheets;

(f) each pair of said plurality of tracks being adapted for slidingly receiving one of said plurality of transparent cover sheets;

(g) each said transparent cover sheet being held spaced from said separable panels by said tracks, the space between said transparent cover and said separable panels being adapted to receive a display sheet;

(h) a bottom cap comprising two L-shaped bottom members;

(i) security means of securing said L-shaped bottom members to the bottom of said separable panels;

(j) said bottom cap including a channel with walls extending beyond the ends of said separable panels when said bottom cap is secured thereto;

(k) a top cap comprising two L-shaped top members;

(l) means for removably fastening said L-shaped top members to the top of said separable panels;

(m) said L-shaped top members having a channel therein with walls extending beyond the top ends of said separable panels when fastened to said separable panels; and (n) said top cap and bottom cap preventing access to the space between said transparent cover sheet and said separable panels.

* * * * *